US012122482B2

(12) United States Patent
Loui et al.

(10) Patent No.: US 12,122,482 B2
(45) Date of Patent: Oct. 22, 2024

(54) WATERCRAFT WITH LIFTING BODIES

(71) Applicant: Hull Scientific Research LLC, Honolulu, HI (US)

(72) Inventors: Steven Loui, Honolulu, HI (US); Emile Suehiro, Honolulu, HI (US); Gary Shimozono, Honolulu, HI (US); Scott Yamashita, Honolulu, HI (US)

(73) Assignee: HULL SCIENTIFIC RESEARCH LLC, Honolulu, HI (US)

( * ) Notice: Subject to any disclaimer, the term of this patent is extended or adjusted under 35 U.S.C. 154(b) by 474 days.

(21) Appl. No.: 17/452,211

(22) Filed: Oct. 25, 2021

(65) Prior Publication Data

US 2022/0135182 A1 May 5, 2022

Related U.S. Application Data

(60) Provisional application No. 63/107,378, filed on Oct. 29, 2020.

(51) Int. Cl.

| | |
|---|---|
| ***B63B 1/24*** | (2020.01) |
| ***B63B 1/28*** | (2006.01) |
| ***B63B 1/30*** | (2006.01) |

(52) U.S. Cl.

CPC ..... *B63B 1/248* (2013.01); *B63B 1/285* (2013.01); *B63B 1/30* (2013.01)

(58) Field of Classification Search

CPC .... B63B 1/00; B63B 1/16; B63B 1/18; B63B 2001/183; B63B 1/20; B63B 1/24; B63B 1/242; B63B 1/248; B63B 1/26; B63B 1/28; B63B 2001/281; B63B 1/285; B63B 1/30

USPC ..... 114/271, 273, 274

See application file for complete search history.

(56) References Cited

U.S. PATENT DOCUMENTS

| | | | | |
|---|---|---|---|---|
| 4,010,705 | A | 3/1977 | Connell et al. | |
| 4,517,912 | A | 5/1985 | Jones | |
| 4,915,048 | A | 4/1990 | Stanford | |
| 5,311,832 | A | 5/1994 | Payne | |
| 5,469,801 | A | 11/1995 | Payne | |
| 5,551,369 | A * | 9/1996 | Shen | B63B 1/248 114/274 |
| 5,601,047 | A * | 2/1997 | Shen | B63B 1/248 114/274 |
| 5,653,189 | A | 8/1997 | Payne | |
| 6,782,839 | B1 | 8/2004 | Nozaki | |
| 7,617,793 | B2 | 11/2009 | Van Oossanen | |
| 8,893,640 | B2 | 11/2014 | Stephinson et al. | |
| 9,090,314 | B2 | 7/2015 | Ulgen | |
| 9,944,356 | B1 | 4/2018 | Wigley | |

(Continued)

OTHER PUBLICATIONS

Bowers, A, et al., "On Wings of the Minimum Induced Drag: Spanload Implications for Aircraft and Birds," National Aeronautics and Space Administration, Armstrong Flight Research Center, NASA technical publication ; 2016-219072, Mar. 2016, 22 pages.

*Primary Examiner* — Daniel V Venne

(74) *Attorney, Agent, or Firm* — McCoy Russell LLP

(57) ABSTRACT

A watercraft system is provided. The watercraft system includes a lifting body designed to generate dynamic lift during watercraft operation. The lifting body is shaped with a twist from the center to the lateral edges and with a chord and a fore-aft cross-section that both decrease from a center of the lifting body to lateral tips of the lifting body.

20 Claims, 9 Drawing Sheets

(56) References Cited

U.S. PATENT DOCUMENTS

| | | | |
|---|---|---|---|
| 10,189,544 | B2 | 1/2019 | Brizzolara et al. |
| 10,556,649 | B2 | 2/2020 | Forrest |

* cited by examiner

WATERCRAFT WITH LIFTING BODIES

CROSS REFERENCE TO RELATED APPLICATION

The present application claims priority to U.S. Provisional Application No. 63/107,378, entitled "WATERCRAFT WITH LIFTING BODIES", and filed on Oct. 29, 2020. The entire contents of the above-listed application are hereby incorporated by reference for all purposes.

TECHNICAL FIELD

The present description relates generally to a watercraft including a lifting body.

BACKGROUND/SUMMARY

Hydrodynamic lifting bodies are used to generate dynamic lift during watercraft motion. Hydrodynamic lifting bodies have the ability to decrease drag and increase watercraft speed. Certain lifting bodies generate both static and dynamic lift. In lifting bodies that generate static lift, watercraft wave excitation may be reduced. Watercrafts utilizing lifting bodies may, in some cases, achieve greater watercraft efficiency as well as seakeeping and sea-kindliness, which may be particularly desirable in locations with rough prevailing seas, for instance.

U.S. Pat. No. 9,944,356 B1 to Wigley discloses a shape shifting fluid foil with a sliding link that is designed to dynamically alter the profile a skin wrapping the foil. However, the inventors herein have recognized potential issues with the fluid foil taught in U.S. Pat. No. 9,944,356 B1 as well as other types of lifting bodies. For example, the foil's wrapping skin and sliding link may be susceptible to degradation, thereby decreasing the foil's durability which may constrain the foil's applicability. The inventors have further recognized certain issues with hydrofoils designed to generate elliptical lift distributions. The tips of the elliptical hydrofoils, during forward motion, experience relatively heavy hydrofoil tip loading and high yaw instability. This may result in diminishment of the hydrofoil's handling performance. Hydrofoils with elliptical lift distributions may also generate comparatively high drag which is span dependent and may pose design constraints on the hydrofoil.

The inventors have recognized the abovementioned drawbacks with previous fluid foils and developed a watercraft system to resolve at least some of the drawbacks. The watercraft system, in one example, includes a lifting body designed to generate dynamic lift during watercraft operation. The lifting body structurally includes a central portion and two opposing lateral sides with lateral edges and exhibits twist from the central portion to the opposing lateral sides. The lifting body further includes a chord and a fore-aft cross-section. Each of the chord and the fore-aft cross-section decrease in directions that extend from a center of the lifting body to the lateral edges. Designing a lifting body with twist and a profile that tapers the chord and fore-aft cross-section decreases drag for a given lift and root bending moment. To elaborate, the lifting body may have greater hydrodynamic efficiency in comparison to a lifting body with an elliptical lift distribution that generates the same amount of lift and results in the same root bending moment. Utilizing the lifting body with a twist (e.g., a twist range between five degrees and ten degrees, in one use-case example) in conjunction with a tapered chord and fore-aft cross-section in the watercraft, enhances aspects of the watercraft's handling performance, such as yaw stability. The watercraft's customer appeal may be expanded as result of the handling performance gains.

Further in one example, the lift distribution curve generated by the lifting body during motion may taper to zero at each of the body's lateral tips and, in some instances, have a bell shaped profile. Structural characteristics of the lifting body such as twist (from the root to either tip), the fore-aft chord, and/or the foil shape may be blended to attain the bell shaped lift distribution. In this way, the lifting body's efficiency may be further increased for a given lift and bending moment or for a fixed amount of material. The bell shaped lift distribution may further improve the watercraft's handling performance, if so desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-5, 9-21, and 23-24 are drawn to scale, though other relative dimensions may be used.

DETAILED DESCRIPTION

A watercraft system designed to achieve increased efficiency (e.g., increased lift to drag ratio), increased seakeeping, and enhanced watercraft control (e.g., yaw control stability) in comparison to previous lifting bodies that generate elliptical lift distributions is described herein. To achieve the aforementioned benefits, a watercraft is provided with a lifting body having a lift distribution that tapers lift near the lateral tips of the lifting body to form a bell shape. To achieve this lift distribution, the lifting body may exhibit a desired amount of twist along with a chord that tapers from a center of the lifting body to its tips. The inventors, through rigorous computational fluid dynamics (CFD) modeling, found that the bell shaped lift distribution increases the lifting body's lift to drag ratio and decreases tip vortices. To elaborate, this type of lifting body has a higher lift to drag ratio (L/D) for a given lift and root bending moment with a fixed amount of lifting body structural material. Further, this type of lifting body creates inboard vortices which result in upwash at the tips. The tip upwash tilts the lift vector forward so that the component of lift at the tips produce thrust, resulting in increased yaw stability. The lifting body may further be profiled to induce inboard vortices that create an upwash at the tips that tilt the lift vector to produce thrust. Further, the lifting body may be profiled to decrease fluid cavitation. To achieve these characteristics, the lifting body's root chord may be relatively large and the lifting body twist may be relatively small to decrease the cavitation while retaining the bell-shaped lift distribution, in one use-case embodiment. For instance, the deviation of the twist may be 6° or less and the root chord to tip chord ratio may be equal to or greater than 0.2, in one specific example. Further in some examples, the location of maximum camber of the lifting body may be shifted further aft to redistribute the pressure over a larger area to prevent highly localized pressure drop around the leading edge that may cause cavitation.

Figure 1:
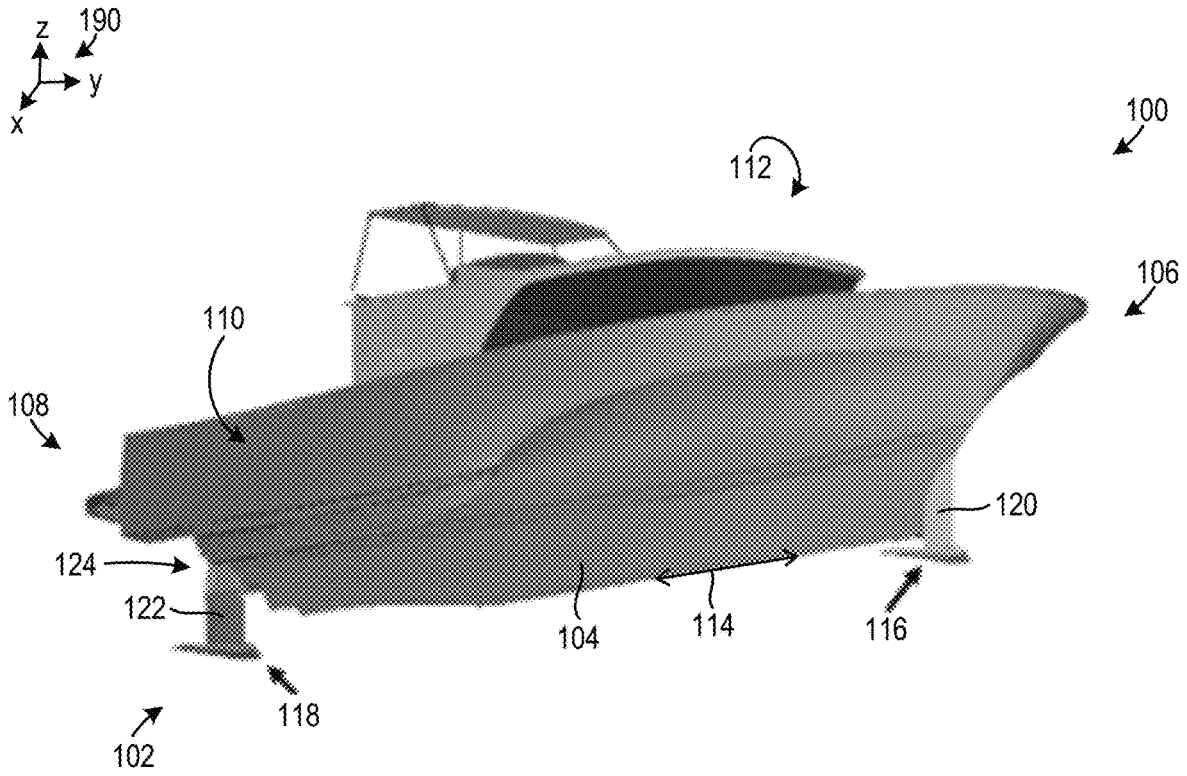
FIG. 1 shows a perspective view of an embodiment of a watercraft with lifting bodies.
Figure 2:
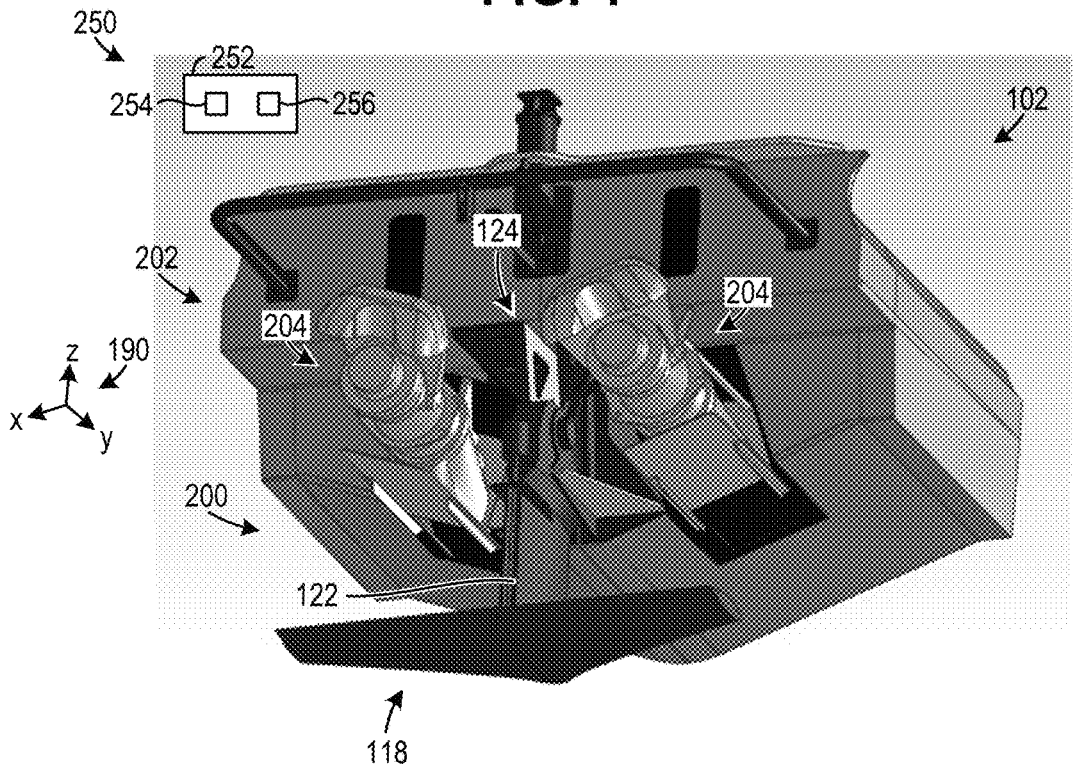
FIG. 2 shows a detailed view of one of the lifting bodies and a propulsion system, depicted in FIG. 1.
Figure 3:
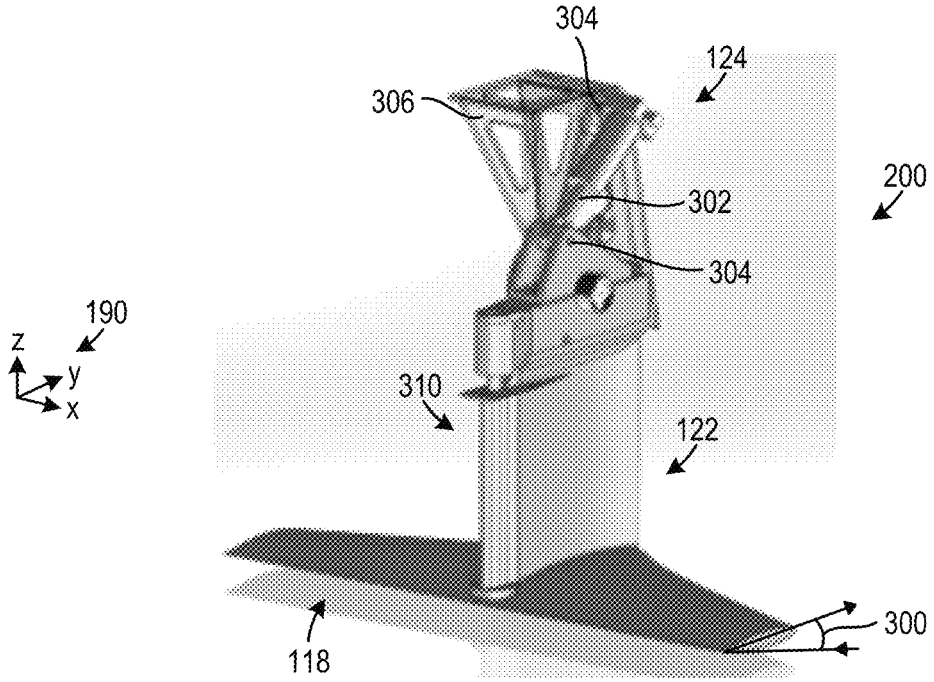
FIG. 3 shows a detailed view of the lifting body assembly, depicted in FIG. 2.
Figure 4:
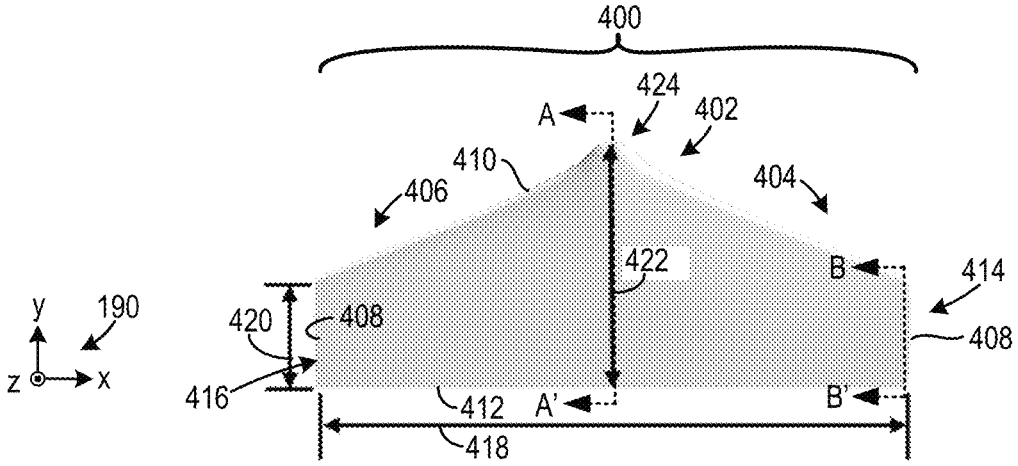
FIG. 4 shows a top view of a first embodiment of a lifting body.
Figure 5:
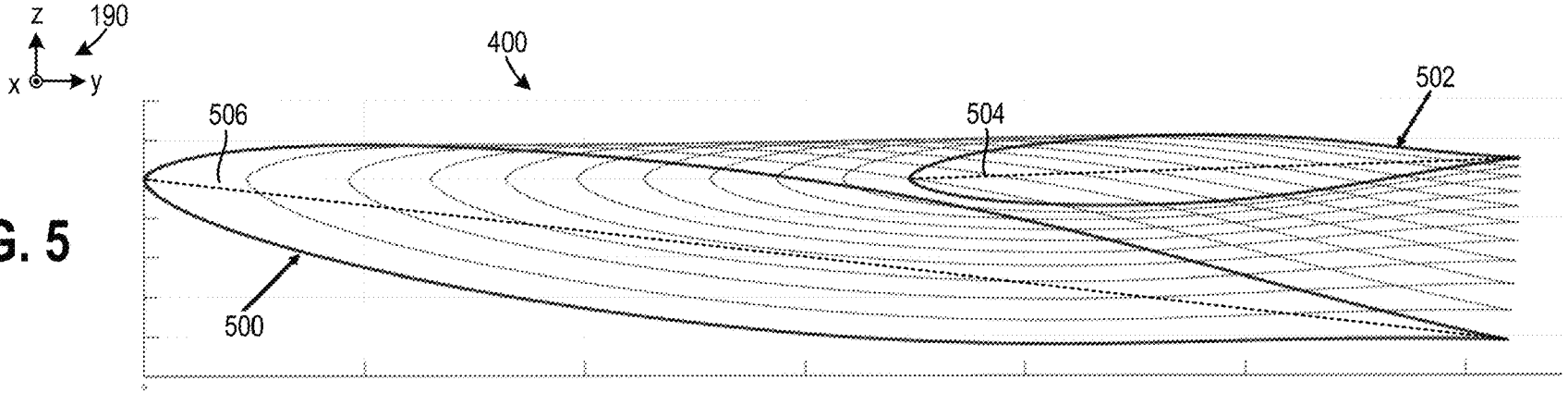
FIG. 5 shows a cross-sectional view of the lifting body, depicted in FIG. 4.
Figure 6:
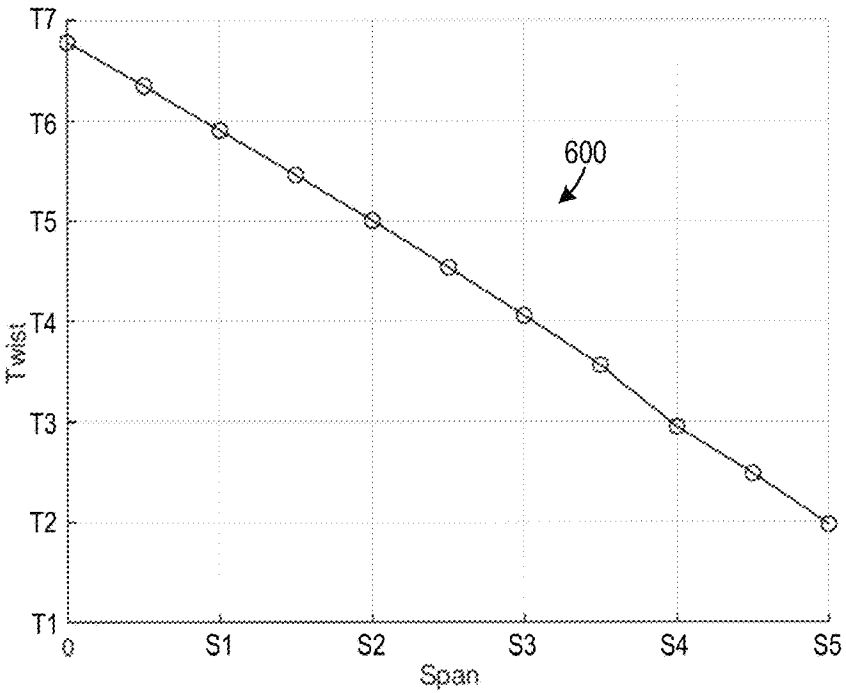
FIG. 6 shows a graph of a use-case lifting body's twist (rotated about a leading edge) vs span.
Figure 7:
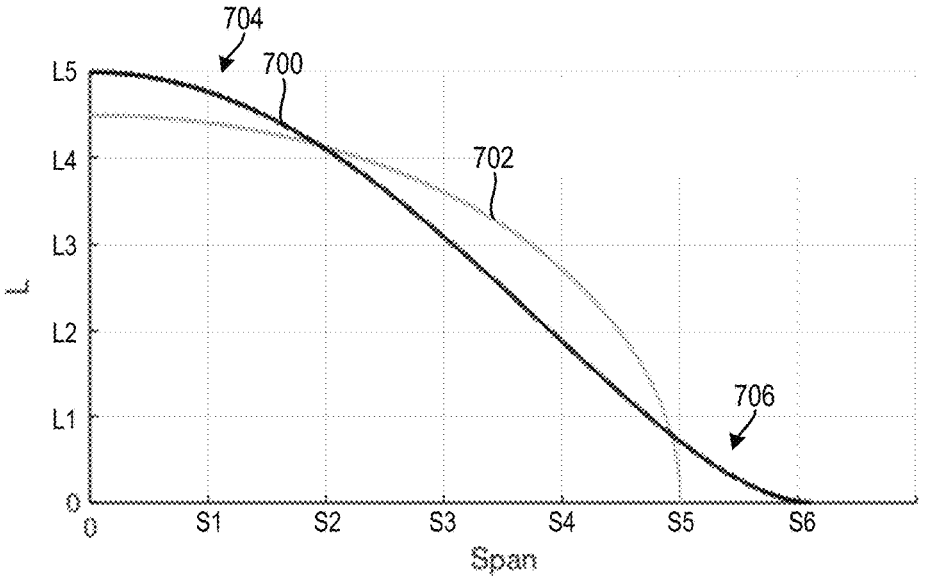
FIG. 7 shows a bell shaped lift distribution curve and an elliptical lift distribution curve corresponding to different lifting body examples.
Figure 8:
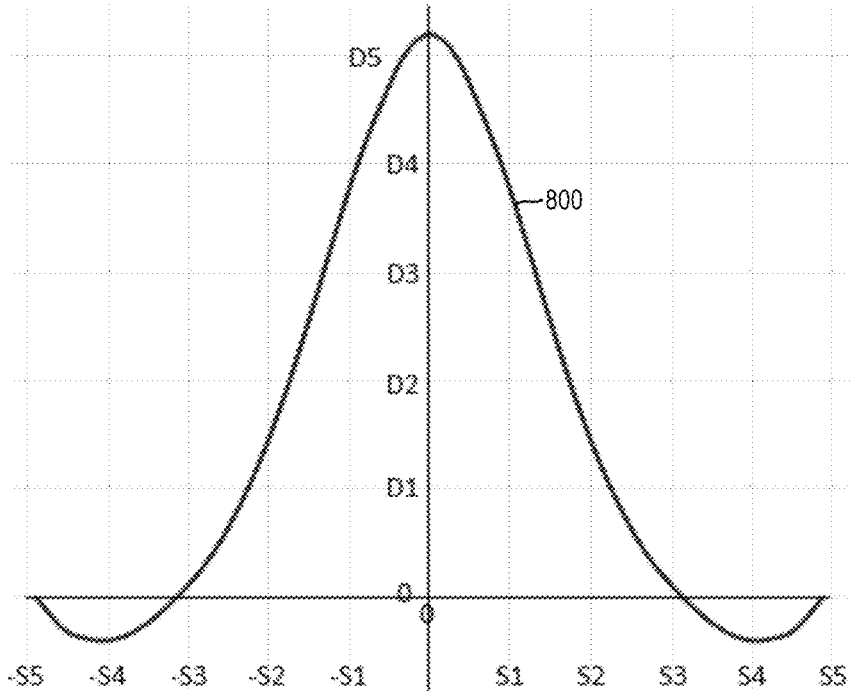
FIG. 8 shows a graph of a use-case lifting body's induced drag vs span.
Figure 9:
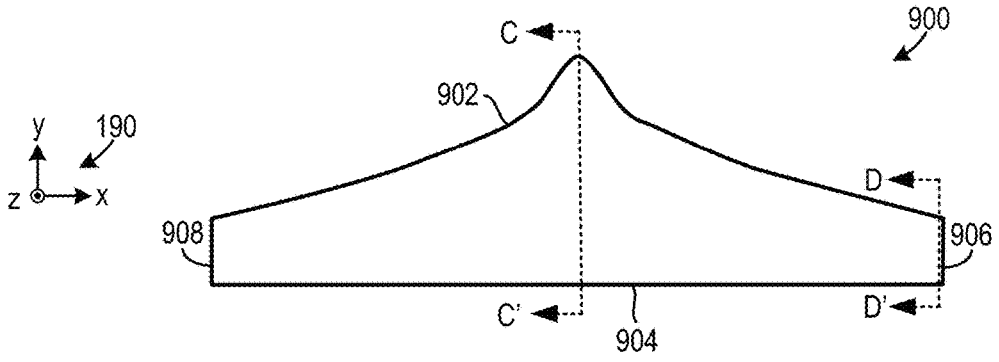
FIG. 9 shows a second embodiment of a lifting body.
Figure 10:
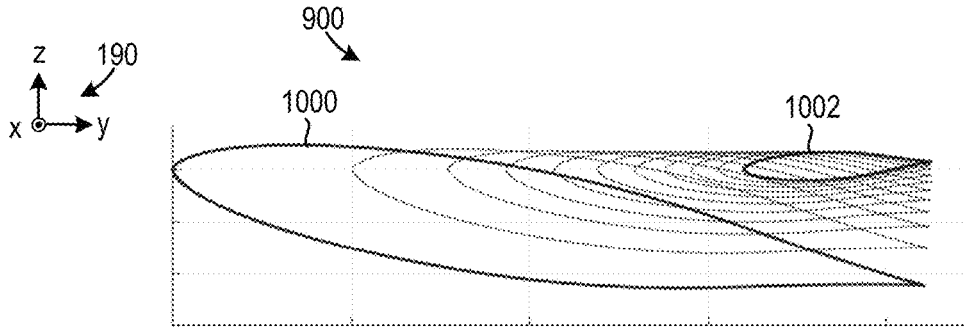
FIG. 10 shows a cross-sectional view of the lifting body, depicted in FIG. 9.
Figure 11:
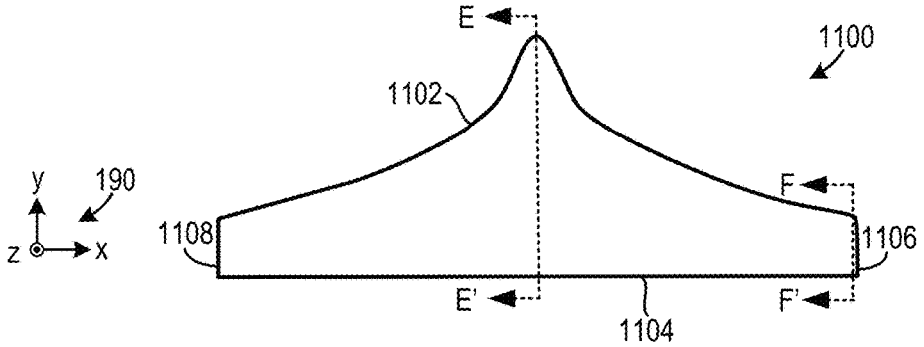
FIG. 11 shows a third embodiment of a lifting body.
Figure 12:
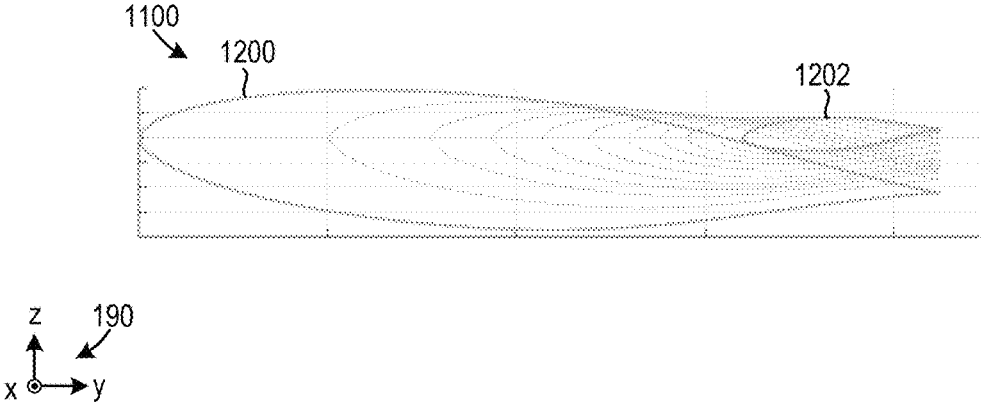
FIG. 12 shows cross-sectional views of the lifting body, depicted in FIG. 11, along the span and rotated about a leading edge.
Figure 13:
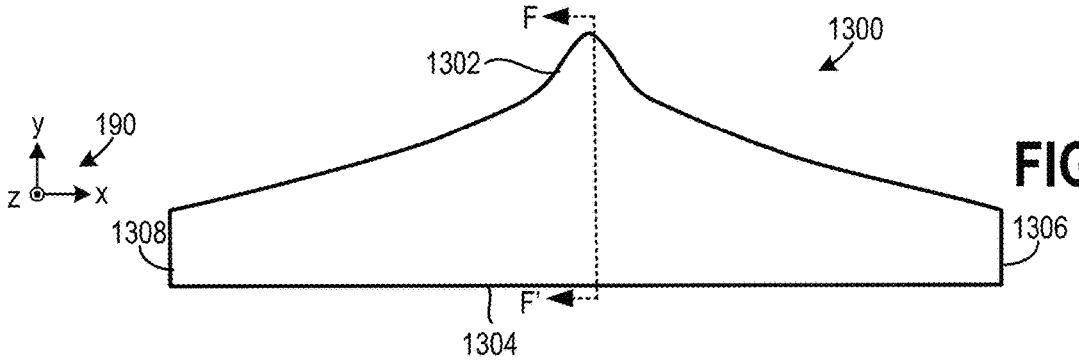
FIG. 13 shows a fourth embodiment of a lifting body.
Figure 14:
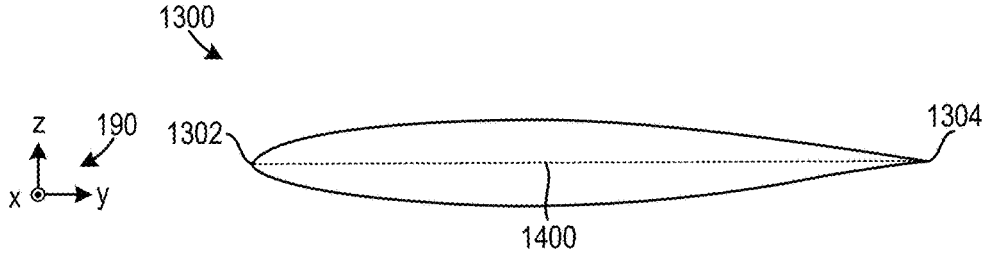
FIG. 14 shows a cross-sectional view of the lifting body, depicted in FIG. 13.
Figure 15:
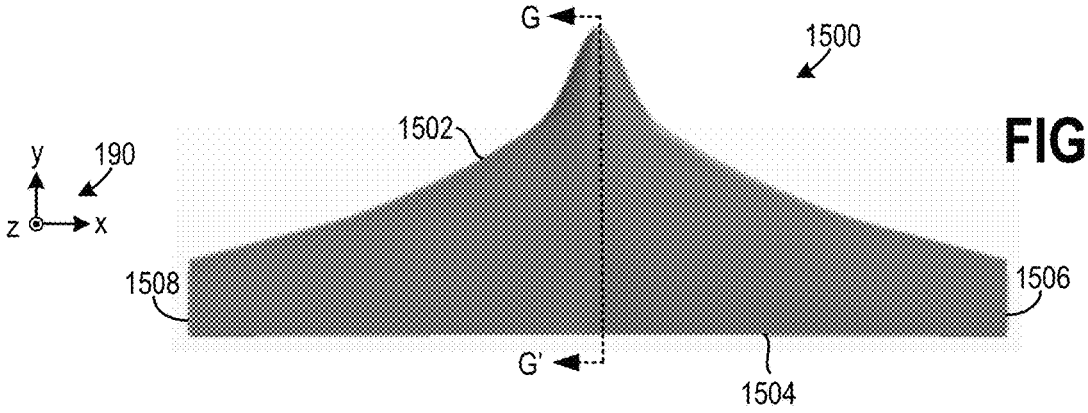
FIG. 15 shows a fifth embodiment of a lifting body.
Figure 16:
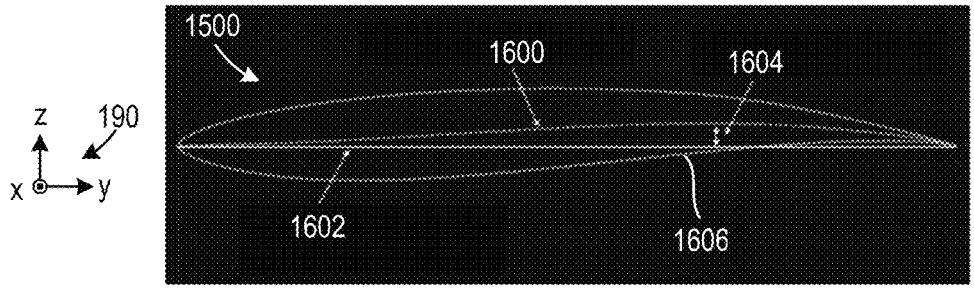
FIG. 16 shows a cross-sectional view of the lifting body, depicted in FIG. 15.
Figure 17:
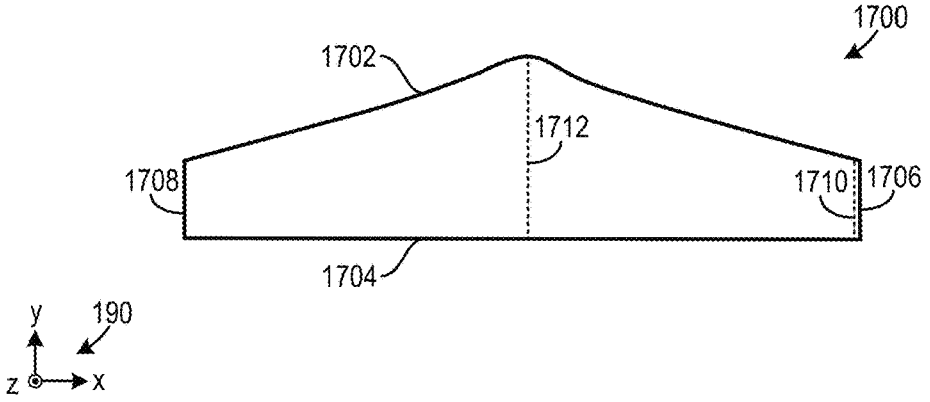
FIG. 17 shows a sixth embodiment of a lifting body.
Figure 18:
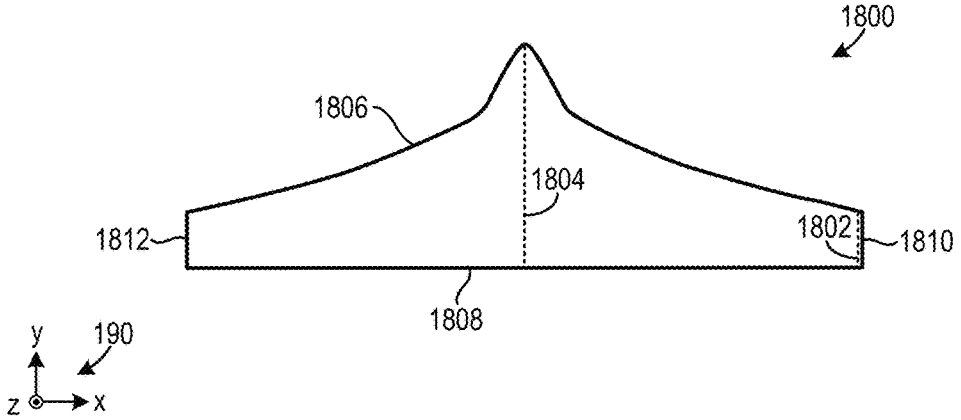
FIG. 18 shows a seventh embodiment of a lifting body.
Figure 19:
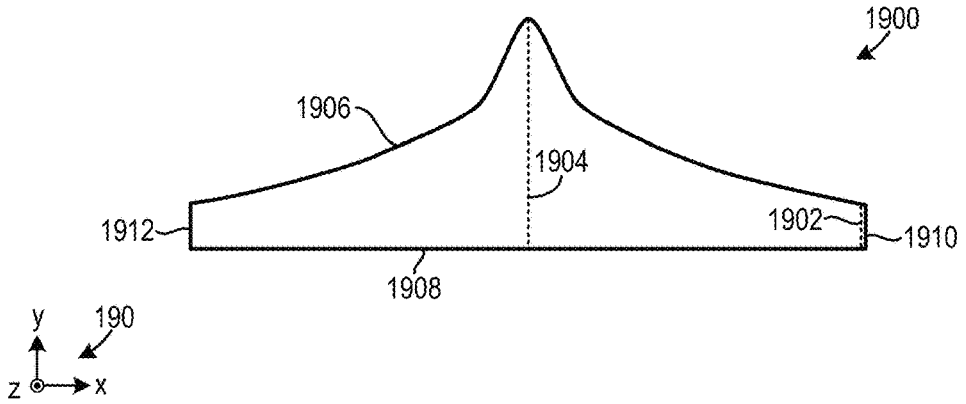
FIG. 19 shows an eighth embodiment of a lifting body.
Figure 20:
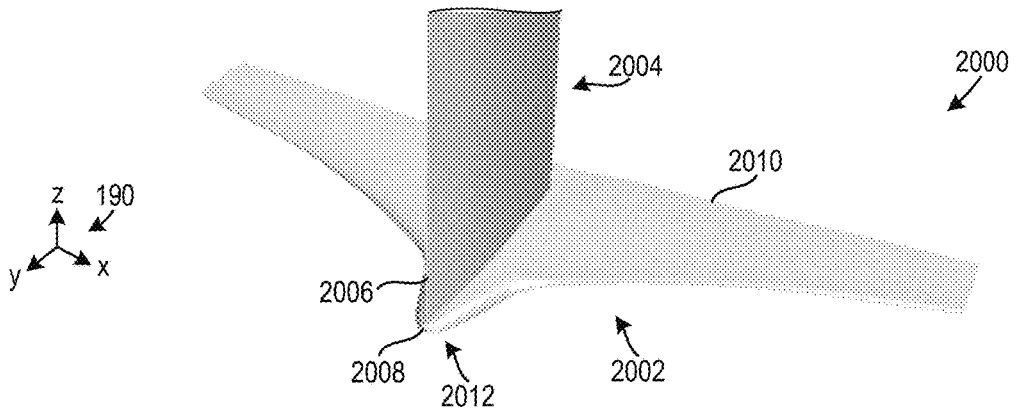
FIG. 20 shows a first example of a lifting body and strut assembly.
Figure 21:
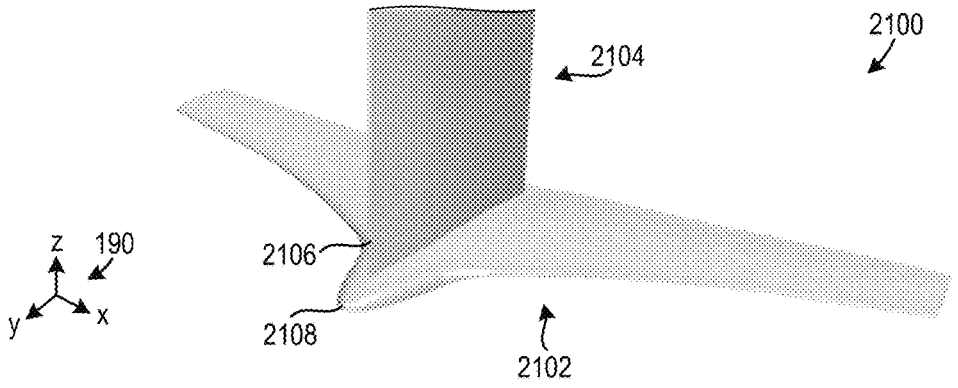
FIG. 21 shows a second example of a lifting body and strut assembly.
Figure 22:
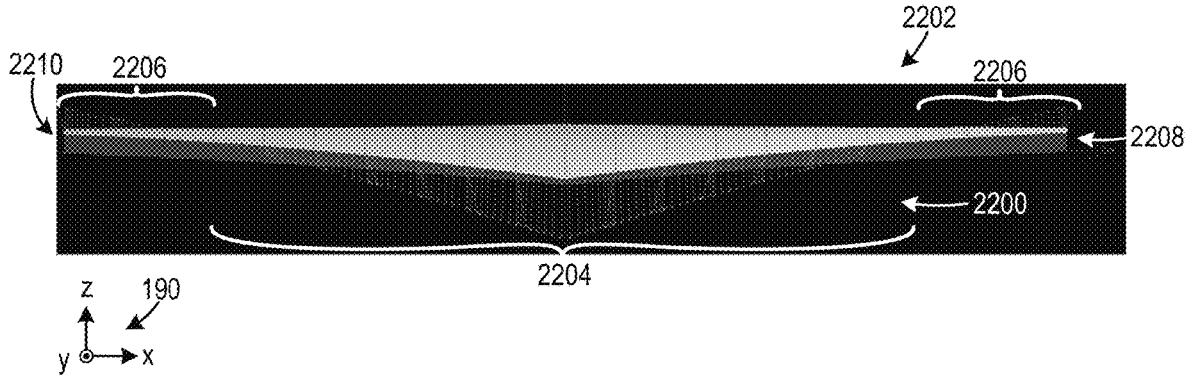
FIG. 22 shows a flow field around a use-case lifting body.
Figure 23:
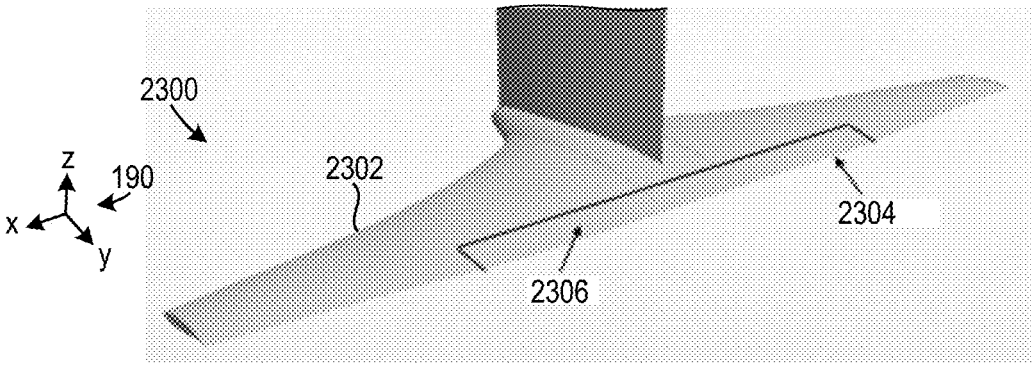
FIG. 23-24 show a ninth embodiment of a lifting body.
Figure 24:
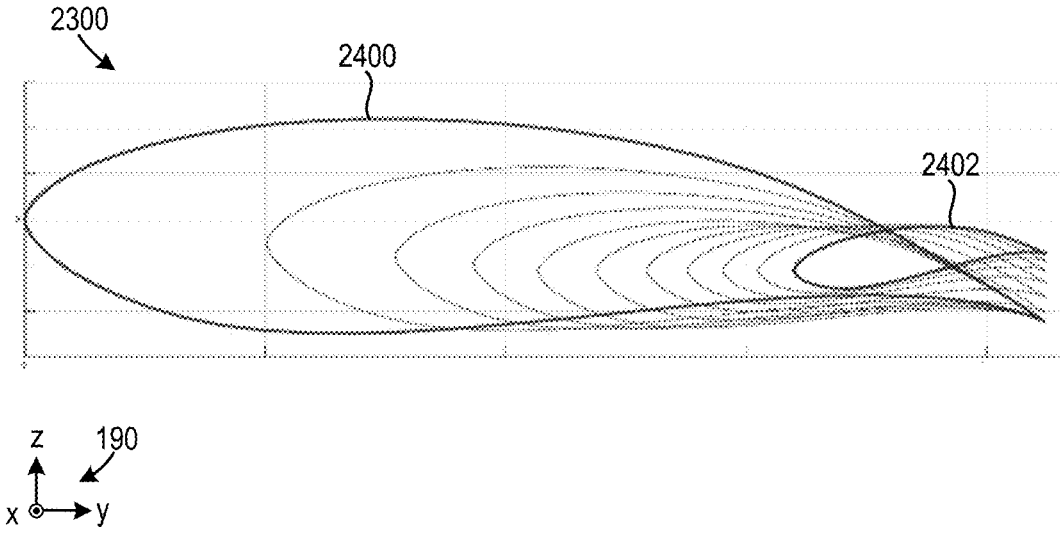

FIG. 1 shows a watercraft with a system having lifting bodies which exhibit increased efficiency and handling performance in comparison to previous lifting bodies. FIGS. 2 and 3 illustrate detailed views of the structural aspects of the watercraft and an aft lifting body, shown in FIG. 1. FIGS. 4-5 show different views of a first embodiment of a lifting body. FIGS. 6-8 illustrate exemplary graphs which denote various lifting body characteristics. As described herein, exemplary signifies one of multiple potential embodiments and does not denote any type of preference. FIGS. 9-10 show different views of a second embodiment of a lifting body. FIGS. 11-12 show different views of a third embodiment of a lifting body. FIGS. 13-14 show different views of a fourth lifting body embodiment and FIGS. 15-16 illustrate a fifth lifting body embodiment with a hydrodynamic cross-sectional contour. FIGS. 17-19 illustrate a sixth, seventh, and eighth lifting body embodiment, respectively. FIGS. 20-21 show different strut arrangements in a lifting body assembly. FIG. 22 depicts a lifting body's flow field exemplifying the upwash generated at the lifting body's tips which may, under some operating conditions, generate thrust. FIGS. 23-24 illustrate another embodiment of a lifting body with a straight trailing edge section that enable a flap to be efficiently integrated into the lifting body.

Additionally, FIGS. 1-5 and 9-24 include an axis system 190 with an x-axis, y-axis, and z-axis, for spatial reference. In one example, the z-axis may be vertically aligned (e.g., parallel to gravitational axis, the y-axis may be longitudinally aligned, and the x-axis may be laterally aligned. However, other orientations of the axes are possible.

FIG. 1 shows a perspective view of an example watercraft 100 with a system 102 designed to generate lift and hull 104. The watercraft 100 includes a bow 106, a stern 108, a starboard side 110, and a port side 112. As described herein, fore refers to a direction extending toward the bow 106 while aft refers to a direction extending toward the stern 108. Additionally, inboard refers to a direction extending inward toward a centerline 114 of the watercraft 100, parallel to the y-axis. On the other hand, outboard refers to a direction extending outward away from the centerline 114 of the watercraft 100, parallel to the y-axis.

The watercraft system 102 may include a fore lifting body 116 and an aft lifting body 118. However, the watercraft system may include an alternate number of lifting bodies such as more than two lifting bodies, in one example, or a single lifting body, in another example. As described herein, a lifting body is a hydrodynamic element which generates dynamic lift. Further in some examples, the lifting body may additionally generate static lift. Alternatively, in another example, the lifting body may primarily generate dynamic lift. In the alternate example, the lifting body may be referred to as a hydrofoil.

The fore and the aft lifting bodies 116, 118 are designed to generate lift distribution profiles which taper near the lateral sides of the lifting bodies. The tapered lift distribution increases lifting body efficiency, increases the watercraft's seakeeping ability, and handling performance. Structural features which allow the lifting bodies to realize these the efficiency and handling performance gains are expanded upon herein.

The fore lifting body 116 may be coupled to the hull 104 via a strut 120 and the aft lifting body 118 is correspondingly coupled to the hull via strut 122. In one example, the strut 120 may remain substantially fixed with regard to the hull 104 and fore lifting body 116. Further, the strut may extend in a fore-aft direction, in some instances. Still further in one example, the strut may exhibit symmetry about a longitudinal axis, include a curved leading edge, and include a tapered trailing edge. These geometric characteristics of the strut may be selected to reduce flow separation generated by the strut during watercraft motion to reduce drag.

An angle of attack of the fore lifting body 116 may be in the range of 6°-10°, in one embodiment. It will be appreciated that increasing the lifting body's angle of attack may correspondingly increase the chance of the lifting body generating pressure cavitation. The lifting body's angle of attack may be selected based on factors such as the watercraft's hull profile, the watercraft's expected operating environment, dynamic lift objectives, etc.

Further in one example, the strut 122 may include an adjustment mechanism 124, shown in FIGS. 2 and 3, designed to adjust an angle of attack of the aft lifting body 118. The adjustment mechanism 124 may further include a rudder designed to adjust the watercraft's yaw. In this way, the adjustment mechanism may provide turning authority and stability to the watercraft. However, in other embodiments, the adjustment mechanism may be configured to solely adjust the lifting body's angle of attack or may be omitted from the watercraft system. Thus, in some examples, angle of attack of the fore and aft lifting bodies may be substantially fixed.

The fore and aft lifting bodies 116, 118 are designed to taper the lift generated during forward motion of the lifting body near the tips. In one embodiment, the fore and aft lifting bodies 116, 118 may have a similar geometry. When the lifting bodies have similar geometries, manufacturing cost reductions may be realized. However, in an alternate embodiment, the profile of the fore and aft lifting bodies 116, 118 may be differ. In such an example, the profile of the lifting bodies may be selected to reduce flow interference between the lifting bodies.

FIG. 2 shows a detailed view of the watercraft system 102 with the aft lifting body 118, strut 122, and adjustment mechanism 124 included in a lifting body assembly 200 as well as the propulsion system 202. The propulsion system 202 may include propulsion sources 204 designed to generate thrust to move the watercraft through the water. For instance, the propulsion sources 204 may include an electric motor, an internal combustion engine, rotors, propellers, mechanical linkage, and the like. In the illustrated embodiment, the aft lifting body 118, strut 122, and adjustment mechanism 124 are laterally positioned between two propulsion sources 204 in the propulsion system. However, other relative positions between the aft lifting body and propulsion sources have been envisioned.

The watercraft 100 may further include a control system 250 with a controller schematically depicted at 252. The controller 252 may include memory 254 and a processor 256. The memory 254 may store instructions executable by the processor 256 to perform control strategies, such as maneuvering strategies. Furthermore, the controller 252 may further receive control inputs from a watercraft operator to maneuver the watercraft as well as various watercraft sensors. The memory may include known data storage mediums such as volatile and non-volatile memory, such as random access memory (RAM) and read only memory (ROM), respectively, and the like. Further, the processor may include one or more microprocessors. The controller 252 may send control signals, commands, etc. to controllable components such as the adjustment mechanism and receive signals from sensors and/or components in the watercraft. It will therefore be understood that the controller 252 may be in electronic communication (e.g., wired and/or wireless communication) with the sensors and controllable components. For instance, the controller 252 may send commands to the adjustment mechanism 124. Responsive to receiving the control command, an actuator in the adjustment mechanism 124 may adjust the angle of attack of the lifting body 118. To elaborate, the angle of attack may be adjusted based on operating conditions such as watercraft speed, operator input, etc. However, in other embodiments, the adjustment mechanism 124 may be manually adjusted via the watercraft operator.

FIG. 3 shows a detailed view of the lifting body assembly 200 which may include the lifting body 118, the strut 122, and the adjustment mechanism 124. As previously discussed, the adjustment mechanism 124 may be designed to adjust an angle of attack 300 of the lifting body 118. The angle of attacked is measured from a reference line, such as a chord line that extends through the lifting body, and a vector representing the flow direction of the fluid, during watercraft motion.

The adjustment mechanism 124 may be manually or automatically adjusted, as previously indicated. To accomplish said adjustment, the mechanism 124 may include an adjustable piston 302, pivots 304, linkage 306, and/or other suitable components. Thus, the piston 302 may be retracted and extended to alter the lifting body's angle of attack. The piston may therefore be arranged at an angle with regard to a horizontal plane. The angle of the piston may be selected based on the piston's stroke length, the targeted range of attack adjustment, the hull's profile, etc. The adjustment mechanism 124 may further include a rudder 310 which pivots to adjust watercraft yaw.

FIG. 4 shows a detailed view of a first embodiment of a lifting body 400. It will be appreciated that the lifting body 400 as well as the other lifting bodies described herein may be included in the watercraft 100, shown in FIGS. 1-3. Further, embodiments combining structural and/or functional features of the different lifting body embodiments described herein lie within the scope of the disclosure.

The lifting body 400 includes a central portion 402 and two opposing side portions 404, 406. The side portions 404, 406 may each include a lateral edge 408. Furthermore, the lateral edge may have a substantially planar profile. However, concave, convex, and chamfered lateral edges have been contemplated. Furthermore, the lifting body 400 includes a leading edge 410 and a trailing edge 412. As shown in FIG. 4, the trailing edge 412 is straight in shape, which may increase the lifting body's structural integrity in comparison to an angled trailing edge. However, other shapes of the trailing edge have been envisioned. Conversely, the leading edge 410 is angled rearward (e.g., swept), in the illustrated example. In this way, the lifting body's fore-aft cross-sectional area may taper in lateral directions which extend from the center of the lifting body 400. The tapered cross-section along with a twist of the lifting body allows the lift distribution generated by the lifting body to diminish near the tips 414, 416 to decrease tip vortices in the flow field. Instead, in the bell shaped lift distribution, the magnitude of the vortices may be reduced and shifted inboard. The handling performance of the watercraft may be enhanced due to the change in position and magnitude of the lifting body vortices. For instance, the weaker inboard vortices may generate upwash near the lifting body tips.

The lifting body may further be profiled to induce inboard vortices that create an upwash. This upwash tilts the lift vector to achieve negative drag over at least a portion of the operating angles of attack, thereby increasing lifting body efficiency and handling performance. To expound, focusing more load inboard and taper the load to zero at the tips enables the lifting body span to be increased without increasing the root bending moment when compared to lifting bodies with elliptical lift distributions and shorter spans. Further, a reduction in the tip vortices is a consequence of the bell shaped lift distribution. As such, for a given lift and bending moment, the reduction in the tip vortices and an increase in the lifting body's span enables the lifting body's efficiency to be increased in comparison to a lifting body having an elliptical lift distribution with a shorter span.

The span of the lifting body 400 measured between the lateral edges 408 is indicated at 418. The tip chord is indicated at 420 and the root chord is indicated at 422. In one example, the span 418 may be less than or approximately equal to 2.2 meters (m), the root chord 422 may be less than or approximately equal to 0.75 m, and/or the tip chord 420 may be less than or approximately equal to 0.375 m. However, other relative dimensions of the lifting body have been contemplated. The dimensions of the lifting body may be selected based on a variety of factors such as watercraft size, watercraft performance targets, lifting body material construction, expected watercraft operating environment, and the like. As described herein, a chord is a straight longitudinal line joining the leading edge to the trailing edge of the lifting body, hydrofoil, and the like.

The lifting body 400 may have a parabolic nose 424. To elaborate, the parabolic nose 424 may form a body of revolution. Thus, the nose's parabolic cross-section may extend circumferentially around a section of the root chord 422 adjacent to the leading edge 410 of the lifting body 400.

Cutting planes A-A' and B-B' indicate the cross-sectional views illustrated in FIG. 5. Specifically, the cutting plane A-A' is located at the lifting body's root and cutting plane B-B' is adjacent to one of the tips of the lifting body.

FIG. 5 depicts cross-sections of the lifting body 400 in fore-aft cutting planes. To elaborate, a fore-aft cross-section of the lifting body's root is indicated at 500 and a fore-aft cross-section of the lifting body's tip is indicated at 502. As shown, the cross-section of the lifting body decreases from the root to the tip. In one use-case example, a ratio between a tip chord 504 and a root chord 506 may be approximately 0.44. However, other ratios have been contemplated. For instance, the ratio between the tip and root chords may be in the range between 0.5 and 0.15, in one embodiment.

FIG. 6 shows a plot 600 of a use-case lifting body with twist on the ordinate and span on the abscissa. It will therefore be understood, that the lifting body 400, shown in FIGS. 4-5 may have the twist and span profile exemplified in FIG. 6. However, other suitable profiles of the lifting body may be used, in other embodiments. The zero value of the span is indicated in the plot along with linear points of interest of both twist and span, although numerical values of the twist and span are not specifically denoted. In one use-case example, the lifting body's twist deviation may be approximately 10° (e.g., from −2° at the tip to 8° at the root), as measured from a horizontal plane, and the span may be approximately 1.0 m. However, numerous twist and span combinations may be used. The lifting body's twist may be selected based on target handling characteristics. It has been found through CFD modeling that if the lifting body has greater lift near the root and less lift near the tips, the lifting body's efficiency may not be sensitive to more granular adjustments to the lifting body's twist distribution. It will be appreciated that FIG. 6 depicts an example of a twist distribution that may result in a bell-shaped lift distribution. However, in alternate examples, other twist distributions, such as nonlinear twist distributions may be used to achieve a bell shaped lift distribution.

FIG. 7 shows a lift distribution plot 700 of an exemplary lifting body having a bell shape and an elliptical lift distribution plot 702 of a lifting body. Lift is on the ordinate and span is on the abscissa. The bell shaped plot may correspond to one of the lifting bodies described herein, such as the lifting body 400, shown in FIGS. 4-5. To elaborate, the plot 700 includes a central convex section 704 and two lateral concave sections 706. However, lifting bodies with alternate lift distribution curves lie within the scope of the disclosure. As shown, the origin of the graphs is indicated along with linear points of interests of both lift and span, although exact numerical values are not indicated. As shown, the bell shaped lift distribution curve tapers near the lateral tip of the span. As previously discussed, the tapered lift distribution allows vortices to be moved inward with a diminished magnitude to increase lifting body efficiency and handling performance.

FIG. 8 shows a plot 800 with induced drag on the ordinate and span on the abscissa. The origin is indicated in FIG. 8 along with linear points of interest on both the ordinate and the abscissa. On the abscissa, the negative S values represent the lateral length of the lifting body measured from the center of the lifting body and extending in a port direction and the positive S values represent the lateral length of the lifting body measured from the center of the lifting body and extending in a starboard direction. As shown in FIG. 8, negative drag (thrust) is generated near the tips of the lifting body, thereby increasing lifting body efficiency.

FIG. 9 shows a second embodiment of a lifting body 900. The lifting body 900 again includes a leading edge 902, a trailing edge 904, and opposing lateral edges 906, 908. Cutting planes C-C' indicates a cross-section of the root of the lifting body, depicted in FIG. 10, and D-D' indicate a cross-section of the lifting body near the lateral edge, depicted in FIG. 10.

FIG. 10 depicts cross-sections of the lifting body 900 in fore-aft cutting planes. To elaborate, a fore-aft cross-section of the lifting body's root is indicated at 1000 and a fore-aft cross-section of the lifting body's tip is indicated at 1002. In one embodiment, the deviation of twist as measured from the lifting body's chord to the tip may be approximately 10° or less (e.g., from −2° at the tip to 8° at the root).

FIG. 11 shows a third embodiment of a lifting body 1100. The lifting body 1100 again includes a leading edge 1102, a trailing edge 1104, and opposing lateral edges 1106, 1108. Cutting planes E-E' indicates a cross-section of the root of the lifting body, depicted in FIG. 12, and F-F' indicate a cross-section of the lifting body near the lateral edge, depicted in FIG. 12.

FIG. 12 depicts cross-sections of the lifting body 1100 in fore-aft cutting planes. To elaborate, a fore-aft cross-section of the lifting body's root is indicated at 1200 and a fore-aft cross-section of the lifting body's tip is indicated at 1202. In one embodiment, the twist deviation as measured from the lifting body's chord to the tip may be approximately 5° or less (e.g., from −2° at the tip to 3° at the root). However, other twist deviations may be used, in other embodiments.

In comparison to the second embodiment of the lifting body 1000, shown in FIGS. 9-10, the lifting body 1100 has an increased root chord and decreased twist. The increased root chord length and decreased twist of the lifting body allows the lifting body to achieve a bell shaped lift distribution with a reduced amount of twist. In turn, the reduction in the lifting body's twist makes the lifting body less prone to cavitation.

FIG. 13 shows a fourth embodiment of a lifting body 1300 which includes a leading edge 1302, a trailing edge 1304, and opposing lateral edges 1306, 1308. Cutting planes F-F' indicates a cross-section of the lifting body, depicted in FIG. 14. FIG. 14 shows a fore-aft cross-section of the lifting body 1300 with a camber line 1400.

FIG. 15 shows a fifth embodiment of a lifting body 1500 comprising a leading edge 1502, a trailing edge 1504, and opposing lateral edges 1506, 1508. Cutting planes G-G' indicates a cross-section of the lifting body depicted in FIG. 16. FIG. 16 shows a fore-aft cross-section of the lifting body 1500 with a mean camber line 1600, a chord line 1602, and a camber 1604. It has been found that by adding camber and shifting it aft, lift can be generated without high angles of attack and without a large pressure drop around the leading edge. Decreasing the localized pressure drop around the leading edge may enable the lifting body 1500 to achieve increased efficiency while mitigating the effects of cavitation in comparison to the lifting body 1300. Additionally, the asymmetric shape of the lifting body 1500 about the camber line 1600 as well as the convex undersurface 1606 may further enable the lifting body to achieve efficiency gains. The lifting body with the convex undersurface may be used in conjunction with a decreased amount of twist (e.g., 5° or less of twist deviation from the root to the tip) and an appropriate chord distribution to increase lifting body efficiency while mitigating cavitation effects.

FIGS. 17-19 depict a sixth, seventh, and eighth lifting body embodiment 1700, 1800, 1900, respectively. Turning specifically to FIG. 17, the lifting body 1700 includes a leading edge 1702, a trailing edge 1704, and lateral edges 1706, 1708. The lifting body's tip chord 1710 and root chord 1712 are further depicted. In one example, a ratio between the tip chord 1710 and the root chord 1712 may be 0.44.

In FIG. 18 the lifting body 1800 includes a tip chord 1802 and a root chord 1804. A ratio of a tip chord 1802 and a root chord 1804 may be 0.25. The lifting body 1800 further includes a leading edge 1806, a trailing edge 1808, and lateral edges 1810, 1812.

In FIG. 19 the lifting body 1900 includes a tip chord 1902, a root chord 1904, a leading edge 1906, a trailing edge 1908, and lateral edges 1910, 1912. A ratio of the tip chord 1902 and the root chord 1904 may be 0.20. More generally, in other embodiments, the tip chord to root chord ratio may be in the range between 0.2 to 0.44. Profiling the lifting body within this tip-root chord ratio enables the lifting body to achieve greater efficiency for a selected lift and root bending moment. Furthermore, pairing this tip-root chord ratio with a parabolic nose further increases lifting body efficiency.

FIG. 20 shows yet another embodiment of a lifting body assembly 2000 including a lifting body 2002 coupled to a strut 2004 with a leading edge 2006 extending to a leading edge 2008 of the lifting body. A trailing edge 2010 of the lifting body extends rearward but does not reach the trailing edge of the lifting body, in the illustrated embodiment. The lifting body 2002 has a nose 2012 which may be parabolic in shape, in one example. The parabolic nose of the lifting body further increases the lifting body's efficiency for a given lift and root bending moment, as previously discussed.

Conversely, FIG. 21 shows a lifting body assembly 2100 including a lifting body 2102 coupled to a strut 2104 with a leading edge 2106 of the strut spaced away from a leading edge 2108 of the lifting body. Through CFD analysis, it has been found that more forward positioned strut, shown in FIG. 20, leverages leading edge suction to increase the lifting body assembly's efficiency in comparison to the strut with a more rearward position, shown in FIG. 21.

In another embodiment, a lifting body may be provided with a modified local cross-sectional shape to control cavitation and/or lift. For instance, a leading edge shape of the lifting body may be altered in specific sections to reduce pressure drops and associated cavitation. For instance, the curve of the leading edge may be more or less pronounced in selected areas to tune the cavitation and lift generated by the lifting body. Consequently, lifting body efficiency may be further increased.

FIG. 22 shows a flow field 2200 emanating from a trailing edge represented via arrows around a lifting body 2202. In the flow field, downwash can be seen at the center portion of the lifting body and upwash can be seen at the tips of the lifting body. The lifting body's lift distribution generates inboard vortices which result in the flow field illustrated in FIG. 22 with downwash near the center of the lifting body and upwash near the lifting body tips. Section 2204 of the vector field indicates downwash near a central portion of the lifting body and sections 2206 indicate upwash near the lateral sides 2208, 2210 of the lifting body. As previously discussed, generating both upwash and downwash in this manner creates thrust to further enhance lifting body performance.

FIG. 23 shows yet another embodiment of a lifting body 2300 that exhibits twist. The twist in the lifting body 2300 is implemented by rotating the fore-aft sections about the trailing edge 2304 from the root to the midspan while rotating fore-aft sections from the midspan to the tips about the leading edge 2302. This results in a straight trailing edge of the lifting body (from root to midspan). Profiling the lifting body in this manner allows a flap 2306 to be more easily incorporated into the lifting body. To elaborate, the straight trailing edge section may free up space to fit trailing edge flap actuators, rods, etc. into the lifting body. Further, it has been found that designing a lifting body with the abovementioned twist distribution does not have a significant effect on lifting body moments or efficiency when compared to lifting bodies with a fully nonlinear trailing edge. In this way, lifting body twist can be implemented via the rotation of selected sections about the trailing edge, enabling simplified flap implementation (e.g., increased feasibility of incorporating a trailing edge flap with internal actuation into the lifting body) without compromising lifting body performance when compared to lifting bodies that implement twist via the rotation of the leading edge.

FIG. 24 depicts cross-sections of the lifting body 2300 in fore-aft cutting planes. To elaborate, a fore-aft cross-section of the lifting body's root is indicated at 2400 and a fore-aft cross-section of the lifting body's tip is indicated at 2402. As shown, the lifting body has a non-linear leading edge and a straight trailing edge from the root to the midspan.

The technical effect of providing a watercraft assembly with a lifting body that generates a lift distribution which tapers lift near lateral sides of the lifting body increases lifting body efficiency and handling performance, thereby increasing watercraft efficiency.

Further, FIGS. 1-5 and 9-24 show the relative positioning of the various components of the watercraft assembly. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Elements offset or opposite from one another may be referred to as such, in one example. Unless otherwise indicated, the terms "approximately" and "substantially" may be construed to mean plus or minus five degrees or less from a value or range.

In the following paragraphs, the subject matter of the present disclosure is further described. According to one aspect, a watercraft system is provided which comprises a lifting body configured to generate dynamic lift during watercraft operation and including a central portion and two opposing lateral sides with lateral edges; wherein the lifting body has a chord and a fore-aft cross-section that each decrease from a center of the lifting body to each of the lateral edges; wherein the lifting body twists from the center to each of the lateral edges.

According to another aspect, a watercraft system is provided that comprises a hydrofoil configured to generate dynamic lift during watercraft operation and including a central portion and two opposing lateral sides with lateral edges; wherein the hydrofoil twists from the central portion to the lateral edges and is configured to generate a lift distribution curve during forward motion of the watercraft system that tapers to zero at the lateral edges.

In another aspect, a lifting structure in a fluid medium is provided that comprises a lifting body designed to generate dynamic lift in the fluid medium with cross-sectional area parallel to the water surface and decreases in thickness from a center of the lifting body to two opposing lateral edges.

In any of the aspects described herein or combinations of the aspects, the lifting body may generate a lift distribution curve that tapers to zero at each of the lateral edges.

In any of the aspects described herein or combinations of the aspects, the lift distribution curve may be bell-shaped.

In any of the aspects described herein or combinations of the aspects, the lifting body may twist from the center to the lateral edges.

In any of the aspects described herein or combinations of the aspects, an amount of a twist deviation of the lifting body may greater than or equal to five degrees.

In any of the aspects described herein or combinations of the aspects, an amount of a twist deviation of the lifting body may be within a range of five degrees to ten degrees.

In any of the aspects described herein or combinations of the aspects, the watercraft system may further comprise a strut coupled to the lifting body and a watercraft hull.

In any of the aspects described herein or combinations of the aspects, the strut may extend to a leading edge of the lifting body.

In any of the aspects described herein or combinations of the aspects, the lifting body may be configured to generate static lift.

In any of the aspects described herein or combinations of the aspects, the lifting body may be a hydrofoil.

In any of the aspects described herein or combinations of the aspects, a trailing edge of the lifting body may be straight in shape.

In any of the aspects described herein or combinations of the aspects, the lifting body may comprise a parabolic nose.

In any of the aspects described herein or combinations of the aspects, the parabolic nose may form a body of revolution.

In any of the aspects described herein or combinations of the aspects, a ratio of the chord at one of the lateral edges to the chord at the center of the lifting body may be in a range from 0.2 to 0.44.

In any of the aspects described herein or combinations of the aspects, the watercraft system may further comprise an adjustment mechanism coupled to the lifting body and configured to adjust an angle of attack of the lifting body.

In any of the aspects described herein or combinations of the aspects, the lift distribution curve may be bell-shaped and may comprise a central convex section and two lateral concave sections.

In any of the aspects described herein or combinations of the aspects, the hydrofoil may be configured to generate downwash in a central section and upwash in opposing lateral sections.

In any of the aspects described herein or combinations of the aspects, an amount of a twist deviation of the hydrofoil may be within a range of five degrees to ten degrees and wherein a central chord of the hydrofoil may be greater than or equal to 0.6 meters. The central chord may be selected based on vehicle characteristics such as the vehicle's size, weight, operating speed, etc.

In any of the aspects described herein or combinations of the aspects, the watercraft system may further comprise a strut coupled to the hydrofoil and a watercraft hull and an adjustment mechanism coupled to the lifting body and configured to adjust an angle of attack of the hydrofoil.

In any of the aspects described herein or combinations of the aspects, the strut may be coupled to a leading edge of a parabolic nose of the hydrofoil.

In any of the aspects described herein or combinations of the aspects, the lifting structure may include an intermediate body of revolution between the strut and lateral tips.

In any of the aspects described herein or combinations of the aspects, the lifting body may have a bell-shaped lift distribution curve for a given lift and root bending moment which increases lifting body efficiency via a reduction in cavitation and drag generated by the lifting body.

In any of the aspects described herein or combinations of the aspects, the lifting body has twist in the spanwise direction of cross-section that increases lift at the root and taper lift to zero at the tip.

In any of the aspects described herein or combinations of the aspects, the lifting body may provide lift to a payload-carrying body via a strut.

In another representation, a watercraft lifting body assembly is provided which comprises a lifting body coupled to a watercraft hull via a strut and having a cross-sectional area which decreases from a root of the lifting body to two opposing lateral tips of the lifting body and has a twisted shape from the root to the opposing lateral tips.

It will be appreciated that the configurations and routines disclosed herein are exemplary in nature, and that these specific embodiments are not to be considered in a limiting sense, because numerous variations are possible. For example, the above technology can be applied to jet boats, propeller boats, jet skis, and other types of watercraft. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A watercraft system, comprising:

a lifting body configured to generate dynamic lift during watercraft operation and including a central portion and two opposing lateral sides with lateral edges;

wherein the lifting body has a chord and a fore-aft cross-section;

wherein the chord and the fore-aft cross-section each decrease from a center of the lifting body to each of the lateral edges of the lifting body; and wherein the lifting body twists from the center to each of the lateral edges.

2. The watercraft system of claim 1, wherein the lifting body generates a lift distribution curve that tapers to zero at each of the lateral edges.

3. The watercraft system of claim 2, wherein the lift distribution curve is bell-shaped.

4. The watercraft system of claim 1, wherein an amount of a twist deviation of the lifting body is greater than or equal to five degrees.

5. The watercraft system of claim 4, wherein the amount of the twist deviation of the lifting body is within a range of five degrees to ten degrees.

6. The watercraft system of claim 1, further comprising a strut coupled to the lifting body and a watercraft hull.

7. The watercraft system of claim 6, wherein the strut extends to a leading edge of the lifting body.

8. The watercraft system of claim 1, wherein the lifting body is configured to generate static lift.

9. The watercraft system of claim 1, wherein the lifting body is a hydrofoil.

10. The watercraft system of claim 1, wherein a trailing edge of the lifting body is straight in shape.

11. The watercraft system of claim 1, wherein the lifting body comprises a parabolic nose.

12. The watercraft system of claim 11, wherein the parabolic nose forms a body of revolution.

13. The watercraft system of claim 1, wherein a ratio of a chord at one of the lateral edges to a chord at the center of the lifting body is in a range from 0.2 to 0.44.

14. The watercraft system of claim 1, further comprising a flap included in the lifting body.

15. A watercraft system, comprising:

a hydrofoil configured to generate dynamic lift during watercraft operation and including a central portion and two opposing lateral sides with lateral edges;

wherein the hydrofoil twists from the central portion to the lateral edges and is configured to generate a lift distribution curve during forward motion of the watercraft system; and wherein the lift distribution curve tapers to zero at the lateral edges of the hydrofoil.

16. The watercraft system of claim 15, wherein the lift distribution curve is bell-shaped and comprises a central convex section and two lateral concave sections.

17. The watercraft system of claim 15, wherein the hydrofoil is configured to generate downwash in a central section and upwash in opposing lateral sections.

18. The watercraft system of claim 15, wherein an amount of a twist deviation of the hydrofoil is within a range of five degrees to ten degrees and wherein a central chord of the hydrofoil is greater than or equal to 0.6 meters.

19. The watercraft system of claim 15, further comprising:

a strut coupled to the hydrofoil and a watercraft hull; and a flap included in the hydrofoil.

20. The watercraft system of claim 19, wherein the strut is coupled to a leading edge of a parabolic nose of the hydrofoil.

* * * * *